United States Patent [19]

Jacobs

[11] Patent Number: 4,788,475

[45] Date of Patent: Nov. 29, 1988

[54] MULTIPLE DISCHARGE DEVICE HID LAMP WITH PREFERENTIAL STARTING

[75] Inventor: Cornelis A. Jacobs, Bath, N.Y.

[73] Assignee: North American Philips Corporation, New York, N.Y.

[21] Appl. No.: 846,424

[22] Filed: Mar. 31, 1986

[51] Int. Cl.[4] ..... H05B 35/00

[52] U.S. Cl. ..... 315/183; 315/46

[58] Field of Search ..... 315/182, 183, 46, 250, 315/324, 88, 90, 86, 178

[56] References Cited

U.S. PATENT DOCUMENTS

| | | | |
|---|---|---|---|
| 3,860,853 | 1/1975 | Ludloff | 315/324 |
| 4,185,232 | 1/1980 | Ingalls et al. | 315/324 |
| 4,287,454 | 9/1981 | Feuersanger | 315/178 |
| 4,321,506 | 3/1982 | Tsuchihashi et al. | 315/178 |
| 4,377,772 | 3/1983 | Tsuchihashi et al. | 315/63 |
| 4,475,062 | 10/1984 | Radenkovich et al. | 315/88 |

*Primary Examiner*—David K. Moore

*Attorney, Agent, or Firm*—Emmanuel J. Lobato

[57] ABSTRACT

A high intensity discharge lamp having a plurality of discharge device, and a starting aid for preferentially starting one of the discharge devices. Upon initial application of power to the lamp the preferentially started discharge device will start first, and the other discharge devices will not start. A power interruption during lamp operation will cause an interruption in the operation of the discharge device started first, upon reapplication of lamp power one of the other discharge devices that had not been operating will start without a hot restart delay.

13 Claims, 2 Drawing Sheets

FIG.1
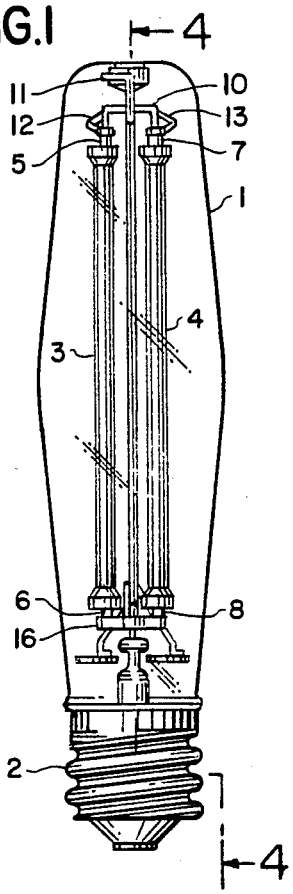
FIG.2
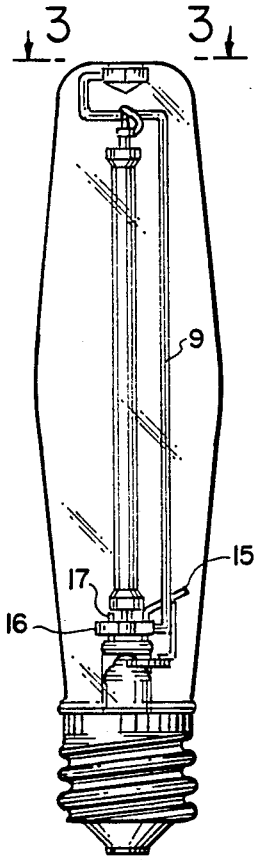
FIG.3
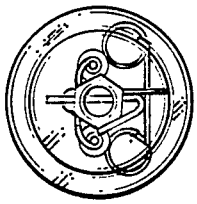
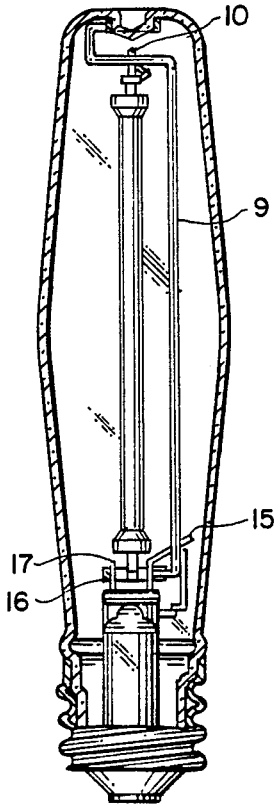
FIG.4

MULTIPLE DISCHARGE DEVICE HID LAMP WITH PREFERENTIAL STARTING

BACKGROUND OF THE INVENTION

The present invention relates to high intensity discharge lamps, and more particularly high intensity discharge lamps having multiple discharge devices.

High intensity discharge (HID) lamps generally include a discharge device having a translucent or transparent vessel that contains an ionizable material. Additionally, the discharge device may include a pair of discharge electrodes within the discharge vessel. In operation, an electrical discharge is developed within the ionizable material and emits light. For example, high pressure sodium discharge lamps have a mercury-sodium amalgam within the discharge vessel, and an inert starting gas. The starting gas is ionized to vaporize some of the amalgam, the vaporized mercury and sodium are ionized, and an intense light-emitting electrical discharge is formed.

The difficulty in restarting an HID lamp after the discharge has been interrupted is well-known. During operation of a typical HID lamp the gas pressure within the discharge vessel attains several atmospheres. When the discharge is interrupted the high internal pressure makes it difficult to reinitiate the discharge, i.e. restart the lamp. Consequently, the discharge vessel must cool until its internal pressure has dropped sufficiently to allow the discharge to be reestablished. The time required for the discharge tube to cool sufficiently to reestablish the discharge is called the hot restart delay.

Because the time required for a hot discharge vessel to cool and the internal pressure to drop sufficiently to allow the lamp to start may be several minutes, or even longer, an element of unreliability is present in lighting systems that rely solely on HID lamps. A momentary power interruption can result in an interruption in lighting service that lasts much longer than the power interruption. In applications where an interruption in lighting service cannot be tolerated, it is necessary to provide auxiliary lighting to furnish light until the HID lamps cool sufficiently to restart.

The problem of providing light during the hot restart delay has been addressed in different ways. One approach is to provide auxiliary incandescent lamps; however, such auxiliary lamps also require control circuitry for operation during periods of hot restart delay. This auxiliary equipment creates additional expense and creates a more elaborate system that that required for just operating the HID lamps.

Another approach to the hot restart problem is the use of more than one discharge device within the same lamp. U.S. Pat. No. 4,287,454 to Feuersanger et al discloses a high pressure discharge lamp in which a pair of lamp discharge devices are contained within the same lamp and connected in parallel. When a starting voltage is applied to the lamp one of the discharge devices operates first, and effectively shunts the second discharge device with a low impedance thereby preventing it from operating. Only the operative discharge device heats sufficiently to elevate its internal pressure and increase its starting voltage. Consequently, if the operating voltage applied to the lamp is interrupted, a reapplied voltage will start the previously inoperative discharge device which will operate without experiencing a hot restart delay.

The hot restart problem has also been addressed by the use of an auxiliary discharge gap exterior to an HID lamp discharge device, but within the lamp outer envelope. A lamp having this structure is disclosed in U.S. Pat. No. 4,377,772 issued to Tsuchihashi et al. This lamp is started in the usual fashion when an operating voltage is applied. After the normal temperature rise in the discharge device, the discharge device will exhibit the usual hot restart delay, if the lamp voltage is interrupted. In this case, reapplication of the lamp voltage during the period of hot restart delay will cause a discharge across the auxiliary discharge gap within the lamp envelope. The discharge across the auxiliary gap will continue until the discharge device cools sufficiently to restart, at which time the voltage drop across the discharge device will decrease and the voltage across the auxiliary discharge gap will be insufficient to continue the auxiliary discharge.

Optical shading caused by one discharge tube blocking the light from another does not occur in the prior art lamp having a single discharge tube and an auxiliary discharge gap within the lamp envelope. For lamps having more than one discharge tube, optical shading is avoided by positioning the discharge tubes aligned axially. This arrangement of discharge tubes is not practicable for high wattage lamps. For example, a 400 watt high pressure sodium HID lamp typically has a discharge vessel about 4.5 inches long and a lamp outer envelope almost eight inches long. In such a lamp having multiple discharge tubes it would not be practicable to axially align the discharge tubes. Optical shading of one discharge device by another is unavoidable when multiple discharge devices are arranged side by side.

It would be an advantage to luminaire design if HID lamps having multiple discharge devices could be made so that the same discharge device always started first, when the lamp is started from a cool condition. In this case the luminaire could be designed to minimize the effect of optical shading by the inoperative discharge device and maximize the use of the light emitted by the preferentially starting discharge device.

SUMMARY OF THE INVENTION

An object of the invention is to provide a high intensity discharge lamp having multiple discharges devices, in which one of the discharge device starts preferentially.

According to the invention a high intensity discharge lamp comprises a plurality of high intensity discharge devices. Each of the discharge devices is responsive to an applied voltage for developing an electrical discharge that emits high intensity light. The discharge devices heat during operation and exhibit a substantially increased starting voltage when heated.

The lamp further comprises mounting means for mounting the discharge devices relative to each other such that heating of one discharge device during operation does not cause substantial heating of another discharge device that is inoperative. The lamp further comprises means for preferentially starting one of the discharge devices when the discharge devices are unheated and exhibit their normal starting voltage with another of the discharge devices remaining inoperative.

In a preferred embodiment of the invention the discharge devices are comprised of a discharge vessel, a pair of discharge electrodes within the discharge vessel, and a discharge vessel filling of an inert starting gas and an ionizable material. The means for preferentially starting is defined by the inert starting gas within one of the discharge devices having a pressure less than the inert starting gas pressure of the other discharge devices.

In another preferred embodiment the means for preferentially starting is comprised of a metallic starting aid positioned proximate one of the discharge devices for imparting to the discharge device a lower starting voltage than that of the other discharge device. The starting aid may advantageously be a metal wire wrapped around the discharge envelope.

BRIEF DESCRIPTION OF THE DRAWING

FIG. 1 is a front elevation of the high intensity discharge lamp according to the invention having two discharge devices;

FIG. 2 is a side elevation of the lamp shown in FIG. 1;

FIG. 3 is a plan view of the lamp shown in FIG. 1;

FIG. 4 is a vertical partial section of the lamp shown in FIG. 1;

DETAILED DESCRIPTION OF THE INVENTION

Figure 5:
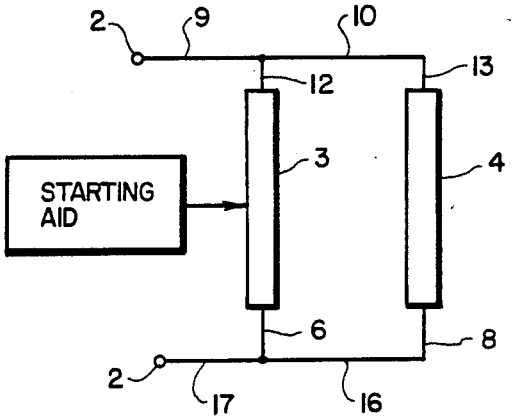
FIG. 5 is a schematic circuit diagram of the high intensity discharge lamp according to the invention.

The lamp according to the invention, shown in FIGS. 1–4, is comprised of an outer glass envelope 1 having a screw base 2 at one end thereof. A pair of discharge devices 3 and 4 are housed within the transparent envelope 1 and are energizable for emitting light.

In the illustrated embodiment the discharge devices 3 and 4 are high pressure discharge lamp discharge tube assemblies. Each of the discharge tube assemblies are comprised of a discharge tube, a pair of internal discharge electrodes within the discharge tube and a fill comprised of an inert starting gas and an ionizable material. Connection to the internal discharge electrodes of the discharge device 3 is made by conductive lead-throughs 5 and 6, and to the internal discharge electrodes of the discharge device 4 by conductive lead-throughs 7 and 8. When a sufficiently high voltage is applied across a pair of the conductive lead-throughs an electric discharge occurs within the discharge device and high intensity visible light is emitted.

The discharge devices 3 and 4 are electrically connected in parallel by the metallic support structure which supports the discharge devices within the lamp envelope 1. Upstanding support rod 9 extends upwardly and supports horizontal member 10 and in anchored at its upper end 11. The horizontal member 10 has downwardly extending end portions which extend to respective tubular lead-throughs 5 and 7 for supporting the upper ends of the discharge devices 3 and 4. Electrical connection between the lead throughs 5 and 7 and the horizontal member 10 is provided by metallic ribbons 12 and 13, each of which is connected between a respective electrode lead-through 5 and 7 and the horizontal member 10.

The support rod 9 extends downwardly to the press 14 and makes connection with a wire lead-through 15. The lead through 15 in turn extends through the press 14 and connects to the screw base 2 to complete the electrical circuit from the screw base 2 to the upper electrodes of the discharge assemblies 3 and 4.

The lower electrode lead-throughs 6 and 8 are connected together mechanically and electrically by the metallic strap 16. This strap is solidly attached to the vertical wire 17 which extends through the press 14 and makes connection with the screw base 2.

The discharge devices 3 and 4 are spaced sufficiently far apart so that operation of discharge device 3 does not heat discharge device 4 too much and raise its starting voltage above that supplied by the lamp starter circuit. Thus, it will be possible to start the discharge device 4 even if discharge device 3 is heated to the point of exhibiting hot restart delay.

The electrical circuit defined by the metallic support structure is illustrated schematically in FIG. 5 in which the conductive paths are identified with the same reference numerals that are used in FIGS. 1–4 to identify the mechanical elements defining those conductive paths.

The discharge devices 3 and 4 are connected electrically in parallel by element 10 and straps 12 and 13, and by strap 16. Consequently, when a potential difference is applied across the screw base 2 the same potential difference is applied across the discharge device 3 and the discharge device 4. If the two discharge devices have substantially the same starting voltage, which discharge device starts first is unpredictable. In order to preferentially start one of the discharge devices, for example discharge device 3, a starting aid, shown schematically in FIG. 5, coacts with the discharge device 3 to start it first, even when the same potential differences are applied across both discharge devices.

The starting aid shown schematically in FIG. 5 can be realized by manufacturing the discharge device 3 with a lower inert fill gas pressure than that of the discharge device 4 to impart a lower starting voltages to it. The respective starting voltages must be sufficiently different so that the discharge device 3 will preferentially start even after the respective starting voltages undergo the inevitable voltage rise that occurs over the life of some HID lamps. At the same time, the starting voltage of both discharge devices 3 and 4 must be within the range of conventional starting voltages. Also, the actual starting voltage must be sufficiently close to its design value so that for large numbers of discharge devices those intended to have the lower starting voltage will always have a starting voltage that is lower by a certain value than those intended to have the higher starting voltage.

In order to test the practicality of defining preferential starting means by choice of inert fill gas pressure, 400 watt high pressure sodium HID lamps were fabricated having discharge devices with different fill gas pressures. These lamps had discharge devices containing a typical sodium-mercury amalgam fill comprised of 18.4 weight % of sodium and 81.6 weight % of mercury. The inert fill gas was pure xenon. The discharge devices were identical except that nineteen of them had a xenon fill pressure of 16 Torr for a nominal starting voltage of 2100 volts, and forty-five of them had a xenon fill pressure of 20 Torr for a nominal starting voltage of 2600 volts.

Two of the higher starting voltage discharge devices filled at 20 Torr had abnormally high starting voltages and are omitted from the following data. Summarized in the table below are the number of discharge devices in each group, the average starting voltage, and the range over which the starting voltage varied within each group.

| number of arc tubes | nominal voltage | average voltage | voltage range |
|---|---|---|---|
| 19 | 2100 V | 2142 V | 2000–2350 V |
| 43 | 2600 V | 2728 V | 2550–2900 V |

The data shows that the starting voltages of the individual discharge devices within each group fell within a range of 350 volts, and the difference between the maximum starting voltage among the discharge devices having the lower nominal starting voltage and the minimum starting voltage among the discharge devices having the higher nominal starting voltage was 200 volts.

The data shows that if randomly selected discharge devices were selected from the two groups and included in the same lamp, in the worst case the starting voltage of one discharge device would be 200 volts lower than the higher starting voltage. The starting voltage of a high pressure sodium discharge device can be expected to rise by about 100 volts over its life, which is just one half the worst case starting voltage difference between the two discharge devices. Thus, the discharge device with the lower starting voltage will preferentially start over the entire life of the lamp, and the use of different inert gas fill pressures to create preferential starting is practical for commercial lamps.

Lamps were made having two discharge devices, with different starting voltages, from the discharge devices just described. In each case the discharge device having the lower starting voltage started first. During lamp operation, when power was interrupted resulting in interruption of the operating and heated discharge device, the second discharge device having the higher starting voltage would, upon reapplication of lamp power, start without hot restart delay.

Figure 6:
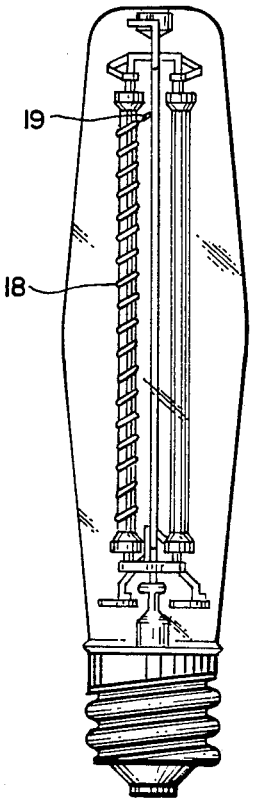
FIG. 6 is a front elevation of another embodiment of the high intensity discharge lamp according to the invention.

In another embodiment of the invention shown in FIG. 6, structure defining the preferential starting aid is defined by a metallic helical coil 18 wound around one of the discharge devices. The operation of this type of starting aid is described in detail in U.S. Pat. No. 4,491,766 which is incorporated herein by reference. The metal spiral 18 is electrically connected to the support rod 9 through the diode 19.

The diode has a polarity effective to impart a positive potential to the metal spiral 18 during each alternating half cycle of the applied voltage. For at least a half of each alternating current cycle the potential which is applied to the metal spiral 18 will be positive and opposite that of one of the discharge electrodes. This positive voltage causes local ionization within the discharge device and an incipient discharge. Electrons from the discharge are accelerated by the field between the discharge electrodes and enhance the formation of the main discharge. The main discharge occurs at a lower voltage than if the metal spiral 18 were not present and biased.

The invention disclosed herein is not limited to the particular embodiments shown. For example, discharge devices of the electrodeless type can be used.

What is claimed is:

1. In a high intensity discharge lamp, the improvement comprising:

an outer lamp envelope;

a plurality of high intensity high pressure discharge devices within said lamp envelope and each responsive to an applied voltage for developing an electrical discharge to emit highly intense light, wherein said discharge devices are each comprised of a discharge vessel, a pair of discharge electrodes within said discharge tube, an inert starting gas, and an ionizable material, and said discharge devices heating during operation and exhibiting a substantially higher starting voltage when hot than when cold;

mounting means for mounting said high pressure discharge devices within the lamp relative to each other such that heating of one discharge device during operation does not heat another discharge device sufficiently to substantially increase the starting voltage of said another discharge device; and means for preferentially starting a particular one of said high pressure discharge devices when said discharge devices are unheated and exhibit their normal starting voltage with said another of said discharge devices remaining inoperative.

2. In a high intensity discharge lamp according to claim 1, said means for preferentially starting is defined by the inert starting gas within said one of said discharge devices having a pressure less than the inert starting gas pressure of said another discharge device.

3. In a high intensity discharge lamp according to claim 2, wherein said means for preferentially starting is defined by the inert starting gas within said one of said discharge devices having a pressure of about 5 torr less than the inert starting gas pressure of said another discharge device.

4. In a high intensity discharge lamp according to claim 1, wherein said means for preferentially starting is comprised of a metallic starting aid positioned proximate said one of said discharge devices for imparting to said one discharge device a lower starting voltage than that of said another discharge device.

5. In a high intensity discharge lamp according to claim 4, wherein said metallic starting aid is a metal wire wrapped around said discharge device.

6. In a high intensity discharge lamp of the type comprising a lamp envelope, a plurality of high pressure discharge devices within said lamp envelope, each of said discharge devices comprising a discharge vessel containing a pair of discharge electrodes and a discharge sustaining filling, and means for electrically connecting said discharge devices in parallel to apply the same starting voltage to each of said discharge devices, the improvement comprising:

means for preferentially starting one of said discharge devices when said discharge devices are unheated and exhibit their normal starting voltage so that the preferentially started discharge device starts first.

7. In a high intensity discharge lamp according to claim 6, wherein said discharge devices each exhibit a particular starting voltage when unheated, an operating voltage lower than the starting voltage, and a restarting voltage when heated that is higher than the starting voltage, and said means for preferentially starting said one of said discharge devices comprises means for lowering the particular starting voltage of said one of said discharge devices.

8. In a high intensity discharge lamp according to claim 7, said means for lowering the particular starting voltage of said one of said discharge devices is defined by the inert starting gas within said one of said discharge devices having a pressure less than the inert starting gas pressure of the other discharge devices for imparting to said one of said discharge devices a lower starting voltage than the other of said starting voltages.

9. In a high intensity discharge lamp according to claim 8, wherein the inert starting gas within said one of said discharge devices has a pressure of about five Torr less than the inert starting gas pressure of the other discharge devices.

10. In a high intensity discharge lamp according to claim 7, wherein said means for lowering the particular starting voltage of said one of said discharge devices is comprised of a metallic starting aid positioned proximate one of said discharge devices for imparting to said discharge device a lower starting voltage than that of the other discharge devices.

11. In a high intensity discharge lamp according to claim 10, wherein said metallic starting aid is a metal wire wrapped around said one of said discharge devices.

12. In a high intensity discharge lamp having a plurality of high pressure discharge devices, each of said discharge devices comprising a discharge vessel containing a pair of discharge electrodes and a discharge sustaining filling, the improvement comprising: one of said high pressure discharge devices having a lower starting voltage than the other of said discharge devices.

13. In a high intensity discharge lamp according to claim 12, a pair of high pressure sodium discharge devices each having a respective starting voltage, and wherein the voltage difference between the respective starting voltages is greater than the expected lifetime rise in starting voltage of the discharge device having the lower starting voltage.

* * * * *